US005238594A

United States Patent [19]

Chapple

[11] Patent Number: 5,238,594

[45] Date of Patent: Aug. 24, 1993

[54] DETERGENT COMPOSITIONS

[75] Inventor: Andrew P. Chapple, Wrexham, Wales

[73] Assignee: Lever Brothers Co., Division of Conopco, Inc., New York, N.Y.

[21] Appl. No.: 903,685

[22] Filed: Jun. 24, 1992

[30] Foreign Application Priority Data

Jun. 25, 1991 [GB] United Kingdom ..... 9113674

[51] Int. Cl.[5] ..... C11D 3/12; C11D 3/39; C11D 3/395; C11D 17/06

[52] U.S. Cl. ..... 252/95; 252/99; 252/131; 252/140; 252/174; 252/174.13; 252/174.14; 252/174.24; 252/174.25; 252/540; 252/559; 423/700

[58] Field of Search ..... 252/95, 99, 131, 140, 252/174, 174.25, 186.27

[56] References Cited

U.S. PATENT DOCUMENTS 4,869,843 9/1989 Saito ..... 252/135
4,915,863 4/1990 Aoyagi ..... 252/102
5,078,895 1/1992 Dany ..... 252/94
5,080,820 1/1992 Grecsek ..... 252/140

FOREIGN PATENT DOCUMENTS 0384070 8/1990 European Pat. Off. .
0448297 9/1991 European Pat. Off. .
0502675 9/1992 European Pat. Off. .
2656009 6/1977 Fed. Rep. of Germany .
1473201 5/1977 United Kingdom .
1515299 6/1978 United Kingdom .
2013259 8/1979 United Kingdom .

*Primary Examiner*—Dennis Albrecht
*Attorney, Agent, or Firm*—James J. Farrell

[57] ABSTRACT

A bleaching particulate detergent composition comprises one or more detergent-active compounds, one or more detergency builders including a specific alkali metal aluminosilicate, maximum aluminum zeolite P (zeolite MAP), and a bleach system comprising sodium percarbonate. Zeolite MAP has a beneficial effect on sodium percarbonate stability.

10 Claims, No Drawings

DETERGENT COMPOSITIONS

TECHNICAL FIELD

The present invention relates to a bleaching detergent composition containing crystalline alkali metal aluminosilicate (zeolite) as a detergency builder, and also including sodium percarbonate bleach.

BACKGROUND AND PRIOR ART

The ability of crystalline alkali metal aluminosilicate (zeolite) to sequester calcium ions from aqueous solution has led to its becoming a well-known replacement for phosphates as a detergency builder. Particulate detergent compositions containing zeolite are widely disclosed in the art, for example, in GB 1 473 201 (Henkel), and are sold commercially in many parts of Europe, Japan and the United States of America.

Although many crystal forms of zeolite are known, the preferred zeolite for detergents use has always been zeolite A: other zeolites such as X or P(B) have not found favour because their calcium ion uptake is either inadequate or too slow. Zeolite A has the advantage of being a "maximum aluminium" structure containing the maximum possible proportion of aluminium to silicon—or the theoretical minimum Si:Al ratio of 1.0—so that its capacity for taking up calcium ions from aqueous solution is intrinsically greater than those of zeolite X and P which generally contain a lower proportion of aluminium (or a higher Si:Al ratio).

EP 384 070A (Unilever) describes and claims a novel zeolite P (maximum aluminium zeolite P, or zeolite MAP) having an especially low silicon to aluminium ratio, not greater than 1.33 and preferably not greater than 1.15. This material is demonstrated to be a more efficient detergency builder than conventional zeolite 4A.

Sodium percarbonate is a well-known bleaching ingredient in detergent compositions and is widely disclosed in the literature, although in recent years its use in commercial products has been abandoned in favour of sodium perborate. Sodium percarbonate is less stable than sodium perborate in the presence of moisture, and its stabilisation in detergent powders has long been recognised as a problem to which various solutions have been suggested; for example, GB 1 515 299 (Unilever) discloses the stabilisation of sodium percarbonate in a detergent composition by admixture with a perfume diluent, for example, dibutyl phthalate.

The problem becomes especially acute if sodium percarbonate is to be included in a detergent powder with a high free moisture content, when it tends to become deactivated on storage. This situation applies in particular to powders containing zeolites, because those materials contain a large amount of relatively mobile water.

Detergent compositions containing alkali metal aluminosilicate (type 4A zeolite) and sodium percarbonate are disclosed in DE 2 656 009A (Colgate), in Examples 1 and 2, but storage stability is not discussed. According to GB 2 013 259A (Kao), the problem of sodium percarbonate stability in the presence of hydrated crystalline zeolites is solved by the use of an amorphous or partially crystalline aluminosilicate (0–75% crystallinity) or by the use of a partially calcium- or magnesium-exchanged material.

It has now unexpectedly been found that replacement of zeolite A by maximum aluminium zeolite P (zeolite MAP) which is the subject of EP 384 070A (Unilever) has a significantly beneficial effect on sodium percarbonate stability. This is surprising because the water content of zeolite MAP is not significantly lower than that of zeolite A.

DEFINITION OF THE INVENTION

The present invention provides a bleaching particulate detergent composition comprising:

(a) one or more detergent-active compounds, (b) one or more detergency builders including alkali metal aluminosilicate, and (c) a bleach system comprising sodium percarbonate, wherein the alkali metal aluminosilicate comprises zeolite P having a silicon to aluminium ratio not greater than 1.33 (hereinafter referred to as zeolite MAP).

DETAILED DESCRIPTION OF THE INVENTION

The subject of the invention is a bleaching detergent composition containing detergent-active compounds, a builder system based on zeolite MAP, and a bleaching system based on sodium percarbonate. These are the essential elements of the invention; other optional detergent ingredients may also be present as desired or required.

The invention preferably provides a detergent composition as defined above, which comprises:

(a) from 5 to 60 wt % of one or more detergent-active compounds, (b) from 10 to 80 wt % of one or more detergency builders, including zeolite MAP, (c) a bleach system comprising from 5 to 30 wt % of sodium percarbonate, (d) optionally other detergent ingredients to 100 wt %, all percentages being based on the detergent composition.

THE DETERGENT-ACTIVE COMPOUND

The detergent compositions of the invention will contain, as essential ingredients, one or more detergent-active compounds (surfactants) which may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch.

The preferred detergent-active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkyl sulphates, particularly $C_{12}$–$C_{15}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_1$-$C_{20}$ aliphatic alcohols ethoxylated with an average of from 1 to 20 moles of ethylene oxide per mole of alcohol, and more especially the $C_{12}$-$C_{15}$ primary and secondary aliphatic alcohols ethoxylated with an average of from 1 to 10 moles of ethylene oxide per mole of alcohol Also of interest are non-ethoxylated nonionic surfactants, for example, alkylpolyglycosides; O-alkanoyl glucosides as described in EP 423 968A (Unilever); and alkyl sulphoxides as described in our copending British Patent Application No. 91 16933.4.

The choice of detergent-active compound (surfactant), and the amount present, will depend on the intended use of the detergent composition: different surfactant systems may be chosen, as is well known to the skilled formulator, for handwashing products and for products intended for use in different types of washing machine.

The total amount of surfactant present will also depend on the intended end use, but will generally range from 5 to 60 wt %, preferably from 5 to 40 wt %.

Detergent compositions suitable for use in most automatic fabric washing machines generally contain anionic non-soap surfactant, or nonionic surfactant, or combinations of the two in any ratio, optionally together with soap.

THE DETERGENCY BUILDER SYSTEM

The detergent compositions of the invention also contains one or more detergency builders The total amount of detergency builder in the compositions will suitably range from 10 to 80 wt %.

The detergency builder system of the compositions of the invention is based on zeolite MAP, optionally in conjunction with one or more supplementary builders. The amount of zeolite MAP present may suitably range from 5 to 60 wt %, more preferably from 15 to 40 wt %.

Preferably, the alkali metal aluminosilicate present in the compositions of the invention consists substantially wholly of zeolite MAP.

ZEOLITE MAP

Zeolite MAP (maximum aluminium zeolite P) and its use in detergent compositions are described and claimed in EP 384 070A (Unilever). It is defined as an alkali metal aluminosilicate of the zeolite P type having a silicon to aluminium ratio not greater than 1.33, preferably within the range of from 0.9 to 1.33, and more preferably within the range of from 0.9 to 1.2.

Of especial interest is zeolite MAP having a silicon to aluminium ratio not greater than 1.15; and zeolite MAP having a silicon to aluminium ratio not greater than 1.07 is especially preferred.

Zeolite MAP generally has a calcium binding capacity of at least 150 mg CaO per g of anhydrous aluminosilicate, as measured by the standard method described in GB 1 473 201 (Henkel) and also described, as "Method I", in EP 384 070A (Unilever). The calcium binding capacity is normally at least 160 mg CaO/g and may be as high as 170 mg CaO/g. Zeolite MAP also generally has an "effective calcium binding capacity", measured as described under "Method II" in EP 384 070A (Unilever), of at least 145 mg CaO/g, preferably at least 150 mg CaO/g.

Although zeolite MAP like other zeolites contains water of hydration, for the purposes of the present invention amounts and percentages of zeolite are generally expressed in terms of the notional anhydrous material. The amount of water present in hydrated zeolite MAP at ambient temperature and humidity is normally about 20 wt %.

PARTICLE SIZE OF THE ZEOLITE MAP

Preferred zeolite MAP for use in the present invention is especially finely divided and has a $d_{50}$ (as defined below) within the range of from 0.1 to 5.0 micrometers, more preferably from 0.4 to 2.0 micrometers and most preferably from 0.4 to 1.0 micrometers.

The quantity "$d_{50}$" indicates that 50 wt % of the particles have a diameter smaller than that figure, and there are corresponding quantities "$d_{80}$", "$d_{90}$" etc. Especially preferred materials have a $d_{90}$ below 3 micrometers as well as a $d_{50}$ below 1 micrometer.

Various methods of measuring particle size are known, and all give slightly different results. In the present specification, the particle size distributions and average values (by weight) quoted were measured by means of a Malvern Mastersizer (Trade Mark) with a 45 mm lens, after dispersion in demineralised water and ultrasonification for 10 minutes.

Advantageously, but not essentially, the zeolite MAP may have not only a small average particle size, but may also contain a low proportion, or even be substantially free, of large particles Thus the particle size distribution may advantageously be such that at least 90 wt % and preferably at least 95 wt % are smaller than 10 micrometers; at least 85 wt % and preferably at least 90 wt % are smaller than 6 micrometers; and at least 80 wt % and preferably at least 85 wt % are smaller than 5 micrometers.

OTHER BUILDERS

The zeolite MAP may, if desired, be used in conjunction with other inorganic or organic builders. However, the presence of significant amounts of zeolite A is not preferred because of its destabilising effect on sodium percarbonate.

Inorganic builders that may be present include sodium carbonate, if desired in combination with a crystallisation seed for calcium carbonate, as disclosed in GB 1 437 950 (Unilever). Organic builders that may be present include polycarboxylate polymers such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts. This list is not intended to be exhaustive.

Builders, both inorganic and organic, are preferably present in alkali metal salt, especially sodium salt, form.

Preferred supplementary builders for use in conjunction with zeolite MAP include citric acid salts, more especially sodium citrate, suitably used in amounts of from 3 to 20 wt %, more preferably from 5 to 15 wt %. This builder combination is described and claimed in EP 448 297A (Unilever).

Also preferred are polycarboxylate polymers, more especially acrylic/maleic copolymers, suitably used in amounts of from 0.5 to 15 wt %, especially from 1 to 10 wt %, of the detergent composition; this builder combination is described and claimed in our copending European Patent Application No. 92 301 766.9 filed on 2 Mar. 1992.

THE BLEACH SYSTEM

Detergent compositions according to the invention contain a bleach system, which is based on the inorganic persalt, sodium percarbonate.

Sodium percarbonate is suitably present in an amount of from 5 to 30 wt %, preferably from 10 to 20 wt %, based on the detergent composition.

OTHER INGREDIENTS

Other materials that may be present in detergent compositions of the invention include sodium silicate; antiredeposition agents such as cellulosic polymers; fluorescers; inorganic salts such as sodium sulphate; lather control agents or lather boosters as appropriate; pigments; and perfumes. This list is not intended to be exhaustive.

PREPARATION OF THE DETERGENT COMPOSITIONS

The particulate detergent compositions of the invention may be prepared by any suitable method.

One suitable method comprises spray-drying a slurry of compatible heat-insensitive ingredients, including the zeolite MAP, any other builders, and at least part of the detergent-active compounds, and then spraying on or postdosing those ingredients unsuitable for processing via the slurry, including the sodium percarbonate and any other bleach ingredients. The skilled detergent formulator will have no difficulty in deciding which ingredients should be included in the slurry and which should not.

The compositions of the invention may also be prepared by wholly non-tower procedures, for example, dry-mixing and granulation, or by so-called "part-part" processes involving a combination of tower and non-tower processing steps.

The benefits of the present invention are observed in powders of high bulk density, for example, of 700 g/l or above. Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP 340 013A, EP 367 339A, EP 390 251A and EP 420 317A (Unilever).

EXAMPLES

The invention is further illustrated by the following Examples, in which parts and percentages are by weight unless otherwise indicated. Examples identified by numbers are in accordance with the invention, while those identified by letters are comparative.

The zeolite MAP used in the Examples was prepared by a method similar to that described in Examples 1 to 3 of EP 384 070A (Unilever). Its silicon to aluminium ratio was 1.07. Its particle size ($d_{50}$) as measured by the Malvern Mastersizer was 0.8 micrometers.

The zeolite A used was Wessalith (Trade Mark) P powder ex Degussa.

The sodium percarbonate used was a 500–710 micrometre sieve fraction of Oxyper (Trade Mark) ex Interox.

The nonionic surfactants used were Synperonic (Trade Mark) A7 and A3 ex ICI, which are $C_{12}$–$C_{15}$ alcohols ethoxylated respectively with an average of 7 and 3 moles of ethylene oxide.

The acrylic/maleic copolymer was Sokalan (Trade Mark) CP5 ex BASF.

EXAMPLE 1, COMPARATIVE EXAMPLE A

Detergent base powders were prepared to the formulations given below (in weight percent), by spray-drying aqueous slurries. Sodium percarbonate (1.25 g per sample) was then admixed with 8.75 g samples of each base powder:

| | 1 | A |
|---|---|---|
| Linear alkylbenzene sulphonate | 10.60 | 10.60 |
| Nonionic surfactant 7EO | 4.90 | 4.90 |
| Soap | 2.90 | 2.90 |
| Zeolite 4A (as anhydrous*) | — | 31.80 |
| Zeolite MAP (as anhydrous*) | 31.80 | — |
| Acrylic/maleic copolymer | 4.80 | 4.80 |
| Sodium alkaline silicate | 0.70 | 0.70 |
| Sodium carbonate | 19.30 | 19.30 |
| SCMC | 0.90 | 0.90 |
| Fluorescer | 0.30 | 0.30 |
| Moisture (nominal)* | 11.00 | 11.00 |
| | 87.50 | 87.50 |
| Sodium percarbonate | 12.50 | 12.50 |
| | 100.00 | 100.00 |

*The zeolites were used in hydrated form, but the amounts are quoted in terms of anhydrous material, the water of hydration being included in the amount shown for total moisture.

Before admixture of the sodium percarbonate, the actual moisture contents of the base powders were determined by measuring weight loss after heating to 135° C. for 1 hour, and were found to be as follows:

| | | |
|---|---|---|
| Moisture (wt %) | 10.3 | 10.2 |

Thus the actual moisture contents of the two base powders were substantially identical.

After admixture of the sodium percarbonate, each powder contained 31.8 wt % of zeolite (anhydrous basis) and 12.5 wt % of sodium percarbonate.

The products were stored in sealed bottles at 28° C. Storage stabilities were assessed by removing samples at different time intervals and measuring their available oxygen content by titration with potassium permanganate. The results, expressed as percentages of the initial value, were as follows:

| Storage time (days) | 1 | A |
|---|---|---|
| 0 | 100 | 100 |
| 7 | 91.0 | 68.6 |
| 14 | 78.2 | 54.0 |
| 42 | 65.5 | 34.8 |
| 56 | 44.1 | 30.0 |

These results show the superior storage stability of the powder containing zeolite MAP.

EXAMPLE 2, COMPARATIVE EXAMPLE B

The procedure of Example 1 was repeated with two base powders having higher zeolite contents:

| | 2 | B |
|---|---|---|
| Linear alkylbenzene sulphonate | 9.00 | 9.00 |
| Nonionic surfactant 7EO | 4.10 | 4.10 |
| Soap | 2.50 | 2.50 |
| Zeolite 4A (as anhydrous) | — | 37.70 |
| Zeolite MAP (as anhydrous) | 37.70 | — |

-continued

| | 2 | B |
|---|---|---|
| Acrylic/maleic copolymer | 4.00 | 4.00 |
| Sodium alkaline silicate | 0.60 | 0.60 |
| Sodium carbonate | 16.40 | 16.40 |
| SCMC | 0.80 | 0.80 |
| Fluorescer | 0.30 | 0.30 |
| Moisture (nominal) | 12.10 | 12.10 |
| | 87.50 | 87.50 |
| Sodium percarbonate | 12.50 | 12.50 |
| | 100.00 | 100.00 |

Before admixture of the sodium percarbonate, the actual moisture contents of the base powders were measured as described in Example 1 and were found to be as follows:

| | | |
|---|---|---|
| Moisture (wt %) | 7.8 | 6.0 |

Thus the powder containing zeolite MAP had a substantially higher moisture content than the control powder containing zeolite A.

After admixture of the sodium percarbonate, each powder contained 37.7 wt % of zeolite (anhydrous basis) and 12.5 wt % of sodium percarbonate.

Storage stabilities were assessed as described in Example 1, and the results were as follows:

| Storage time (days) | 2 | B |
|---|---|---|
| 0 | 100 | 100 |
| 7 | 97.0 | 82.5 |
| 14 | 88.1 | 84.8 |
| 42 | 88.8 | 71.0 |
| 56 | 81.6 | 61.7 |

The results show clearly that the powder containing zeolite MAP was the more stable, despite its higher moisture content.

EXAMPLE 3, COMPARATIVE EXAMPLE C

Spray-dried detergent base powders were prepared to the compositions given in Examples 2 and B, sprayed with nonionic surfactant (3EO) in a rotating drum, and then mixed with sodium percarbonate as in Examples 2 and B. The compositions were then as follows (in weight percent):

| | 3 | C |
|---|---|---|
| Base powder (Example 2) | 78.70 | — |
| Base powder (Example B) | — | 78.70 |
| Nonionic surfactant 3EO | 8.80 | 8.80 |
| Sodium percarbonate | 12.50 | 12.50 |
| | 100.00 | 100.00 |

Before admixture of the sodium percarbonate, the actual moisture contents of the base powders were measured as described in Example 1 and were found to be substantially identical:

| | | |
|---|---|---|
| Moisture (wt %) | 11.9 | 11.7 |

After admixture of the sodium percarbonate, each powder contained 33.90 wt % zeolite (anhydrous basis) and 12.5 wt % sodium percarbonate.

Storage stabilities were assessed as in Example 1 and the results were as follows:

| Storage time (days) | 3 | C |
|---|---|---|
| 0 | 100 | 100 |
| 7 | 88.4 | 74.0 |
| 14 | 75.1 | 60.9 |
| 42 | 68.1 | 48.4 |
| 56 | 69.5 | 28.6 |

Thus spray-on of nonionic surfactant did not affect the superior storage stability exhibited by the zeolite MAP-based powder.

EXAMPLE 4, COMPARATIVE EXAMPLE D

Detergent powders of high bulk density were prepared by granulating and densifying the spray-dried base powders of Examples 3 and C using a Fukae (Trade Mark) FS-30 high-speed mixer/granulator, in the presence of nonionic surfactant (3EO). The mixer was operated at a stirrer speed of 200 rpm and a cutter speed of 3000 rpm, the temperature being controlled at 60° C. by means of a water jacket; the granulation time was 2 minutes.

8.75 g samples were then mixed with 1.25 g samples of sodium percarbonate, as in previous Examples, and the final compositions (in weight percent) were as follows:

| | 4 | D |
|---|---|---|
| Base powder (Example 2) | 75.33 | — |
| Base powder (Example B) | — | 79.45 |
| Nonionic surfactant 7EO | 12.16 | 8.05 |
| Sodium percarbonate | 12.50 | 12.50 |
| | 100.00 | 100.00 |
| Amount of zeolite (anhydr) | 32.46 | 34.36 |
| Bulk density (g/l) (before addition of sodium percarbonate) | 810 | 830 |

Before admixture of the sodium percarbonate, the actual moisture contents of the densified powders were found to be substantially identical:

| | 4 | D |
|---|---|---|
| Moisture (wt %) | 14.8 | 14.6 |

Storage stabilities were assessed as described in Example 1, and the results were as follows:

| Storage time (days) | 4 | D |
|---|---|---|
| 0 | 100 | 100 |
| 7 | 74.4 | 62.2 |
| 14 | 64.2 | 51.4 |
| 42 | 61.9 | 49.1 |
| 56 | 61.5 | 40.6 |

Thus densification of the base powder did not affect the superior storage stability exhibited by the zeolite MAP-based powder.

I claim:

1. A detergent composition which comprises:

(a) from 5 to 60% of one or more detergent-active compounds, (b) from 15 to 80 wt % of one or more detergency builders comprising zeolite MAP, wherein said zeolite MAP is present in an amount of at least 15% by weight of the detergent composition and wherein said zeolite MAP has a silicon to aluminum ratio not greater than 1.33 and a particle size $d_{50}$ within the range of from 0.1 to 5.0 micrometers, (c) a bleach system comprising from 5 to 30 wt % of sodium percarbonate, (d) optionally other detergent ingredients to 100 wt %, all percentages being based on the detergent composition.

2. A detergent composition as claimed in claim 1, wherein the zeolite MAP has a silicon to aluminum ratio not greater than 1.07.

3. A detergent composition or component as claimed in claim 1, wherein the zeolite MAP has a particle size $d_{50}$ within the range of from 0.4 to 1.0 micrometers.

4. A detergent composition or component as claimed in claim 1, wherein the zeolite MAP has a particle size distribution such that at least 90 wt % are smaller than 10 micrometers, at least 85 wt % are smaller than 6 micrometers and at least 80 wt % are smaller than 5 micrometers.

5. A detergent composition or component as claimed in claim 4, wherein the zeolite MAP has a particle size distribution such that at least 95 wt % are smaller than 10 micrometers, at least 90 wt % are smaller than 6 micrometers and at least 85 wt % are smaller than 5 micrometers.

6. A detergent composition as claimed in claim 1, which is substantially free of zeolite A.

7. A detergent composition as claimed in claim 1, wherein the alkali metal aluminosilicate consists substantially wholly of zeolite MAP.

8. A detergent composition as claimed in claim 10, which comprises from 15% to 60 wt % of zeolite MAP.

9. A detergent composition as claimed in claim 1, which comprises from 15 to 40 wt % of zeolite MAP.

10. A detergent composition as claimed in claim 1, which comprises from 10 to 20 wt % of sodium percarbonate.

* * * * *